US010035243B2

(12) United States Patent
Bloch

(10) Patent No.: US 10,035,243 B2
(45) Date of Patent: Jul. 31, 2018

(54) KNIFE SHARPENING DEVICE

(71) Applicant: Outdoor Edge Cutlery Corporation, Denver, CO (US)

(72) Inventor: David R. Bloch, Morrison, CO (US)

(73) Assignee: Outdoor Edge Cutlery Corporation, Denver, CO (US)

( * ) Notice: Subject to any disclaimer, the term of this patent is extended or adjusted under 35 U.S.C. 154(b) by 41 days.

(21) Appl. No.: 14/952,378

(22) Filed: Nov. 25, 2015

(65) Prior Publication Data

US 2016/0144486 A1 May 26, 2016

Related U.S. Application Data

(60) Provisional application No. 62/084,438, filed on Nov. 25, 2014.

(51) Int. Cl.
*B24D 15/08* (2006.01)

(52) U.S. Cl.
CPC ..... *B24D 15/081* (2013.01)

(58) Field of Classification Search
CPC ..... B24D 15/081; B24D 17/065; B24D 17/08
See application file for complete search history.

(56) References Cited

U.S. PATENT DOCUMENTS

| | | | | |
|---|---|---|---|---|
| 620,050 A | | 2/1899 | Poindexter | |
| 1,032,910 A | | 7/1912 | Jackson | |
| 1,223,753 A | | 4/1917 | Anderson | |
| 1,451,526 A | | 4/1923 | Bowles | |
| 1,474,636 A | | 11/1923 | Judd et al. | |
| 1,719,345 A | | 7/1929 | Teitel | |
| 1,827,664 A | | 10/1931 | Matthews | |
| 2,473,702 A | | 6/1949 | Carlin | |
| 2,542,472 A | | 2/1951 | Brinkley | |
| 3,052,068 A | | 9/1962 | Burgess | |
| 4,450,653 A | * | 5/1984 | Fletcher | B24D 15/08 248/171 |
| 4,494,340 A | | 1/1985 | Carter | |
| 4,502,254 A | | 3/1985 | Carter | |
| 4,530,188 A | | 7/1985 | Graves | |
| 4,751,795 A | | 6/1988 | Jenne | |
| 5,163,251 A | | 11/1992 | Lee | |
| 5,377,563 A | | 1/1995 | Weeks | |
| 6,846,229 B1 | | 1/2005 | Ranieri | |
| 7,153,200 B1 | * | 12/2006 | Wu | B24B 41/00 451/344 |

(Continued)

OTHER PUBLICATIONS

Brod & Taylor, Pocket Knife Sharpener—Limited Edition (LE), Sep. 2014 https://brodandtaylor.com/product/pocket-knife-sharpener-le/.*

(Continued)

*Primary Examiner* — Monica Carter
*Assistant Examiner* — Lauren Beronja
(74) *Attorney, Agent, or Firm* — Lewis Brisbois Bisgaard & Smith LLP

(57) ABSTRACT

A handheld, portable knife sharpening device is provided. The knife sharpening device includes a body that accommodates at least one knife sharpening member. The body is interconnected to a rotatable leg that is used to selectively alter the lateral footprint of the device to make knife sharpening safer and more effective.

21 Claims, 5 Drawing Sheets

(56) References Cited

U.S. PATENT DOCUMENTS

| | | | | |
|---|---|---|---|---|
| 8,221,199 | B2 * | 7/2012 | Smith | B24B 3/54 451/461 |
| D745,819 | S | 12/2015 | Bloch | |
| 2005/0197053 | A1 * | 9/2005 | Fierus | B24D 15/08 451/552 |
| 2009/0064822 | A1 | 3/2009 | Sterngold | |
| 2014/0120812 | A1 * | 5/2014 | Smith | B24D 15/081 451/552 |

OTHER PUBLICATIONS

Brod and Taylor, Instruction Manual Pocket & Basic Knife Sharpener, Sep. 2014 PDF.*

Screen grab of Google Search Results containing Date of Website used in rejection.*

"Sharp-Xtm (SX-100)," Outdoor Edge Corp., 2014, retrieved from https://web.archive.org/web/20141111081636/http://www.outdooredge.com/Sharp-X-p/sharp-x.htm, 1 page.

"Joseph Joseph Compact 2-Stage Knife Sharpener and Honer Rota, Red," Amazon, retrieved from http://www.amazon.com/Joseph-Compact-2-Stage-Knife-Sharpener/dp/B00LN714GI/ref=cm_cr-pr_product_top?ie=UTF8, 2014, 6 pages.

International Search Report and Written Opinion for International (PCT) Patent Application No. PCT/US15/62709, dated Feb. 2, 2016, 9 pages.

* cited by examiner

KNIFE SHARPENING DEVICE

This application claims the benefit of U.S. Provisional Patent Application Ser. No. 62/084,438, filed Nov. 25, 2014, the entire disclosure of which is incorporated by reference herein.

This application is also related to U.S. Design Patent Ser. No. 29/507,927, filed Oct. 31, 2014, the entire disclosure of which is incorporated by reference herein.

FIELD OF THE INVENTION

Embodiments of the present invention are generally related to portable knife sharpeners and, more particularly, to hand-held, pull-through knife sharpeners.

BACKGROUND OF THE INVENTION

Knife sharpening devices generally include a pair of crossed abrasive rods or other common sharpening members constructed of compressed ceramic, graphite powder, or serrated hardened steel. A knife blade is sharpened by pulling it across the sharpening members. Many traditional knife sharpening devices are large or fixedly mounted and, thus, not portable. Examples of table-mounted knife sharpeners that employ crossed abrasive members, or other sharpening devices can be found in the following U.S. Pat. No. 620,050 to Poindexter, U.S. Pat. No. 1,032,910 to Jackson, U.S. Pat. No. 1,223,753 to Anderson, U.S. Pat. No. 1,451,526 to Bowles, U.S. Pat. No. 1,719,345 to Teitel U.S. Pat. No. 1,827,664 to Matthews, and U.S. Pat. No. 2,542,472 to Brinkley. U.S. Pat. No. 1,474,636 to Judd et al. and U.S. Pat. No. 2,473,702 to Carlin describe more complex table mounted devices that employ belts that sharpen the blade.

Although portable, hand-held knife sharpeners exist, they lack stability and are dangerous when used. That is, when many existing sharpening devices are used, the user's hand is positioned close to the knife sharpening member, which subjects the user's hand, wrist, or fingers to a risk of injury. For example, some current knife sharpening devices employ crossed abrasive rods supported by a handle, or other holding device. Although reasonably safe, these types of sharpeners have the disadvantage that they are difficult to support; i.e., they float in space and are only supported by the user's other hand, which can be dangerous. In addition, the lack of support may make it difficult to align the blade with respect to the sharpening members, which may cause inefficient or ineffective sharpening. More specifically, one important detail to properly sharpen a knife is to maintain a precise set angle for shaping a new edge on the blade. If the sharpening device is not stable, then any movement of the device during use will alter the angle of the edge applied to the knife, thereby resulting in inefficient or ineffective sharpening. In addition, the lack of support may make it difficult to align the blade with respect to the sharpening members.

Examples of handheld sharpeners can be found in U.S. Pat. No. 1,719,345 to Teital, U.S. Pat. No. 3,052,068 to Burgess, U.S. Pat. No. 4,494,340 to Carter, U.S. Pat. No. 4,502,254 to Carter, U.S. Pat. No. 4,530,188 to Graves, U.S. Pat. No. 4,751,795 to Jenne, and U.S. Pat. No. 6,846,299 to Ranicri. U.S. Pat. No. 5,165,251 to Lee discloses a handheld sharpening device that can be stabilized on a counter, but the device can still rotate about its contact point, which can influence sharpening characteristics.

Thus it is a long felt need in the knife sharpening field to provide a sharpening device that is portable, compact, and yet stable in use. The following disclosure describes an improved knife sharpening device that can assume a compact storage configuration and a stable use configuration.

SUMMARY OF THE INVENTION

It is one aspect of some embodiments of the present invention to provide a compact knife sharpening device that employs at least one knife sharpening member. The sharpening member is situated within a slot or groove of the knife sharpening device designed to selectively receive a knife blade. The sharpening member may be a pair of spaced abrasive sharpening components that selectively engage each side of a knife blade edge. In one embodiment, the sharpening components are angled relative to each other, e.g., crossed. The sharpening components of one embodiment are crossed such that the angle between the sharpening components is about 44°. In operation, a knife blade, or other cutting tool, is positioned in the groove and placed in contact with the sharpening components. The knife blade sharpens as it is pulled through the sharpening member. The contemplated sharpening device aligns the blade so it is oriented to create the optimum blade edge profile as the blade is pulled across the sharpening member.

The knife sharpening device of one embodiment of the present invention has a generally rectangular body that includes a first groove associated with a coarse sharpening member and a second groove associated with fine sharpening member. The body also includes at least one finger recess spaced from the sharpening members, which allows the user to safely grip and stabilize the sharpening device during use. The body also has a base for engagement with a relatively flat surface. The base may have a leg that operatively rotates to increase base's lateral footprint, which drastically enhances stability. One embodiment employs a rotatable leg that may be selectively positioned about 90° relative to a longitudinal axis of the sharpening device body. The base and rotatable leg may include a plurality of gripping pads that further enhance engagement of the device to a horizontal surface. When not in use, the leg is moved to a storage position of use in line with the body. One of ordinary skill in the art will appreciate that the knife sharpening device may be used without the leg deployed and without placing it on a flat surface. However, to ensure proper knife sharpening and to increase safety, the knife sharpening device base should be engaged against a table, counter, work bench, or other flat when used. The sharpening device is further stabilized when the user engages the finger recesses with their thumb and forefinger.

It is another aspect of embodiments of the present invention to provide a knife sharpening device that includes multiple sharpening stages. As mentioned above, the sharpening device may include a coarse sharpening member and a fine sharpening member. The coarse sharpener, which may comprise a pair of carbide plates, is designed to quickly remove metal from the blade. That is, the coarse sharpening member is designed to sharpen dull blades that are slowly pulled across the coarse sharpening components under some pressure. The edges of the plates that contact the knife blade are positioned at about 44° relative to each other. The fine ceramic sharpening member is for finishing a knife edge and for fine-tuning knives after each use. In operation, the fine sharpening member is used to sharpen knives after each use wherein the blade is lightly pulled across the fine sharpening member. The fine ceramic sharpening member may comprise a pair of rods also positioned at about 44° relative to each other. Those of ordinary skill in the art will appreciate that the nature and material makeup of the sharpening members can be selectively altered to fit the needs of the user. The sharpening members of some embodiments of the present invention are removable such that after the sharpening members lose effectivity, they can be removed and adjusted or replaced.

It is another aspect of embodiments of present invention to provide a portable knife sharpening device that is safe. The knife sharpening device is adapted to engage a flat surface that provides stability when the knife sharpening device is used. Further, stability in increased by widening the knife sharpening device's lateral footprint as described above. Stability is also enhanced by providing at least one finger recess that the user pinches, which helps prevent the knife sharpening device from tilting or rotating when in use. The finger recess also tells the user where to put their free hand, which decreases the chance the blade will contact the free hand during sharpening.

In operation, the user rotates the leg and positions it generally perpendicular to the knife sharpening device body, and places the knife sharpening device on a flat surface. Thereafter, the user grips the body portion with their thumb and forefinger to further stabilize the knife sharpening device. Next, assuming the blade is dull, the user places the knife blade in contact with the coarse sharpening member and pulls the blade therethrough several times. The blade is then pulled through the fine sharpening member several times to complete the sharpening process. After sharpening, the leg can be rotated back into place within the base. Accordingly, an easy-to-use system is provided that helps ensure that knives used around the campground, kitchen, professional kitchen, butcher shop, or hunting camp are sharp so they can do their job effectively and efficiently.

It is another aspect of some embodiments of the present invention to provide a knife sharpening device that is easy to store and transport. The contemplated knife sharpening device may be small enough to fit into a user's hand and into their pocket. Further aspects of the present invention are provided in the following embodiments:

A knife sharpening device, comprising: a base portion having an upper surface, a lower surface spaced from the upper surface, the lower surface being generally planar, thereby defining a normal axis; a body portion interconnected to the base portion, the body portion having a first face and a second face spaced from the first face, and an upper surface; a first opening in the upper surface that accommodates a first sharpening member; a second opening in the upper surface that accommodates a second sharpening member; and a leg having a first end and a second end, the leg associated with the base portion and operatively interconnected to the body portion, the leg capable of rotation about an axis parallel to the normal axis of the base portion, and wherein the leg selectively moves from a first position of use, wherein the first end and the second end are positioned adjacent to the body portion, and a second position of use, wherein the first end is positioned away from the first face of the body portion and the second end is positioned away from the second face of the body portion so as to increase a lateral footprint of the knife sharpening device.

A knife sharpening device, comprising: a base portion having an upper surface, a lower surface spaced from the upper surface, the lower surface being generally planar, thereby defining a normal axis; a body portion interconnected to the base portion, the body portion having a first face and a second face spaced from the first face, and an upper surface; a first opening in the upper surface that accommodates a first sharpening member; a second opening in the upper surface that accommodates a second sharpening member; and a leg having a first end and a second end, the leg associated with the base portion and operatively interconnected to the body portion, the leg capable of rotation about an axis parallel to the normal axis of the base portion, and wherein the leg selectively moves from a first position of use, wherein the first end and the second end are positioned adjacent to the body portion, and a second position of use, wherein the first end is positioned away from the first face of the body portion and the second end is positioned away from the second face of the body portion so as to increase a lateral footprint of the knife sharpening device, wherein the at least one of the first sharpening member and the second sharpening member are removable.

A knife sharpening device, comprising: a base portion having an upper surface, a lower surface spaced from the upper surface, the lower surface being generally planar, thereby defining a normal axis; a body portion interconnected to the base portion, the body portion having a first face and a second face spaced from the first face, and an upper surface; a first opening in the upper surface that accommodates a first sharpening member; a second opening in the upper surface that accommodates a second sharpening member; and a leg having a first end and a second end, the leg associated with the base portion and operatively interconnected to the body portion, the leg capable of rotation about an axis parallel to the normal axis of the base portion, and wherein the leg selectively moves from a first position of use, wherein the first end and the second end are positioned adjacent to the body portion, and a second position of use, wherein the first end is positioned away from the first face of the body portion and the second end is positioned away from the second face of the body portion so as to increase a lateral footprint of the knife sharpening device, wherein at least one of the base portion and the leg have compliant pads adapted for selective engagement with a support surface.

A knife sharpening device, comprising: a base portion having an upper surface, a lower surface spaced from the upper surface, the lower surface being generally planar, thereby defining a normal axis; a body portion interconnected to the base portion, the body portion having a first face and a second face spaced from the first face, and an upper surface; a first opening in the upper surface that accommodates a first sharpening member; a second opening in the upper surface that accommodates a second sharpening member; and a leg having a first end and a second end, the leg associated with the base portion and operatively interconnected to the body portion, the leg capable of rotation about an axis parallel to the normal axis of the base portion, and wherein the leg selectively moves from a first position of use, wherein the first end and the second end are positioned adjacent to the body portion, and a second position of use, wherein the first end is positioned away from the first face of the body portion and the second end is positioned away from the second face of the body portion so as to increase a lateral footprint of the knife sharpening device, further comprising a finger recess incorporated in to at least one of the first face and the second face.

A knife sharpening device, comprising: a base portion having an upper surface, a lower surface spaced from the upper surface, the lower surface being generally planar, thereby defining a normal axis; a body portion interconnected to the base portion, the body portion having a first face and a second face spaced from the first face, and an upper surface; a first opening in the upper surface that accommodates a first sharpening member; a second opening in the upper surface that accommodates a second sharpening member; and a leg having a first end and a second end, the leg associated with the base portion and operatively interconnected to the body portion, the leg capable of rotation about an axis parallel to the normal axis of the base portion, and wherein the leg selectively moves from a first position of use, wherein the first end and the second end are positioned adjacent to the body portion, and a second position of use, wherein the first end is positioned away from the first face of the body portion and the second end is positioned away from the second face of the body portion so as to increase a lateral footprint of the knife sharpening device, further comprising a first finger recess incorporated into the first surface and a second finger recess incorporated into the second surface, the first finger recess and the second finger recess being in direct opposition to each other.

A knife sharpening device, comprising: a base portion having an upper surface, a lower surface spaced from the upper surface, the lower surface being generally planar, thereby defining a normal axis; a body portion interconnected to the base portion, the body portion having a first face and a second face spaced from the first face, and an upper surface; a first opening in the upper surface that accommodates a first sharpening member; a second opening in the upper surface that accommodates a second sharpening member; and a leg having a first end and a second end, the leg associated with the base portion and operatively interconnected to the body portion, the leg capable of rotation about an axis parallel to the normal axis of the base portion, and wherein the leg selectively moves from a first position of use, wherein the first end and the second end are positioned adjacent to the body portion, and a second position of use, wherein the first end is positioned away from the first face of the body portion and the second end is positioned away from the second face of the body portion so as to increase a lateral footprint of the knife sharpening device, wherein the first end and the second end are comprised of arcuate outer surfaces that selectively engage corresponding arcuate surfaces integrated into the base portion.

A knife sharpening device, comprising: a base portion having an upper surface, a lower surface spaced from the upper surface, the lower surface being generally planar, thereby defining a normal axis; a body portion interconnected to the base portion, the body portion having a first face and a second face spaced from the first face, and an upper surface; a first opening in the upper surface that accommodates a first sharpening member; a second opening in the upper surface that accommodates a second sharpening member; and a leg having a first end and a second end, the leg associated with the base portion and operatively interconnected to the body portion, the leg capable of rotation about an axis parallel to the normal axis of the base portion, and wherein the leg selectively moves from a first position of use, wherein the first end and the second end are positioned adjacent to the body portion, and a second position of use, wherein the first end is positioned away from the first face of the body portion and the second end is positioned away from the second face of the body portion so as to increase a lateral footprint of the knife sharpening device, wherein the first sharpening member is comprised of a first portion and a second portion positioned at an angle relative to each other, and wherein the second sharpening member is comprised of a first portion and a second portion positioned at an angle relative to each other.

A knife sharpening device, comprising: a base portion having an upper surface, a lower surface spaced from the upper surface, the lower surface being generally planar, thereby defining a normal axis; a body portion interconnected to the base portion, the body portion having a first face and a second face spaced from the first face, and an upper surface; a first opening in the upper surface that accommodates a first sharpening member; a second opening in the upper surface that accommodates a second sharpening member; and a leg having a first end and a second end, the leg associated with the base portion and operatively interconnected to the body portion, the leg capable of rotation about an axis parallel to the normal axis of the base portion, and wherein the leg selectively moves from a first position of use, wherein the first end and the second end are positioned adjacent to the body portion, and a second position of use, wherein the first end is positioned away from the first face of the body portion and the second end is positioned away from the second face of the body portion so as to increase a lateral footprint of the knife sharpening device, wherein the body portion has a panel that when removed exposes the first sharpening member and the second sharpening member.

A knife sharpening device, comprising: a base portion; a body portion interconnected to the base portion; a first opening in the body portion that accommodates a first sharpening member; a second opening in the body portion that accommodates a second sharpening member; and a leg associated with the base portion and operatively interconnected to the body portion, the leg capable of rotation relative to the body portion, and wherein the leg selectively moves from a first position of use to a second position of use wherein an end of the leg is positioned away from the body portion.

A knife sharpening device, comprising: a base portion; a body portion interconnected to the base portion; a first opening in the body portion that accommodates a first sharpening member; a second opening in the body portion that accommodates a second sharpening member; and a leg associated with the base portion and operatively interconnected to the body portion, the leg capable of rotation relative to the body portion, and wherein the leg selectively moves from a first position of use to a second position of use wherein an end of the leg is positioned away from the body portion, wherein the at least one of the first sharpening member and the second sharpening member are removable.

A knife sharpening device, comprising: a base portion; a body portion interconnected to the base portion; a first opening in the body portion that accommodates a first sharpening member; a second opening in the body portion that accommodates a second sharpening member; and a leg associated with the base portion and operatively interconnected to the body portion, the leg capable of rotation relative to the body portion, and wherein the leg selectively moves from a first position of use to a second position of use wherein an end of the leg is positioned away from the body portion, wherein at least one of the base portion and the leg have compliant pads adapted for selective engagement with a surface.

A knife sharpening device, comprising: a base portion; a body portion interconnected to the base portion; a first opening in the body portion that accommodates a first sharpening member; a second opening in the body portion that accommodates a second sharpening member; and a leg associated with the base portion and operatively interconnected to the body portion, the leg capable of rotation relative to the body portion, and wherein the leg selectively moves from a first position of use to a second position of use wherein an end of the leg is positioned away from the body portion, further comprising a finger recess incorporated into the body portion.

A knife sharpening device, comprising: a base portion; a body portion interconnected to the base portion; a first opening in the body portion that accommodates a first sharpening member; a second opening in the body portion that accommodates a second sharpening member; and a leg associated with the base portion and operatively interconnected to the body portion, the leg capable of rotation relative to the body portion, and wherein the leg selectively moves from a first position of use to a second position of use wherein an end of the leg is positioned away from the body portion, wherein the end of the leg is comprised of a shaped surface that selectively engages corresponding shaped surface integrated into the base portion.

A knife sharpening device, comprising: a base portion; a body portion interconnected to the base portion; a first opening in the body portion that accommodates a first sharpening member; a second opening in the body portion that accommodates a second sharpening member; and a leg associated with the base portion and operatively interconnected to the body portion, the leg capable of rotation relative to the body portion, and wherein the leg selectively moves from a first position of use to a second position of use wherein an end of the leg is positioned away from the body portion, wherein the first sharpening member is comprised of a first portion and a second portion positioned at an angle relative to each other, and wherein the second sharpening member is comprised of a first portion and a second portion positioned at an angle relative to each other.

A knife sharpening device, comprising: a base portion; a body portion interconnected to the base portion; a first opening in the body portion that accommodates a first sharpening member; a second opening in the body portion that accommodates a second sharpening member; and a leg associated with the base portion and operatively interconnected to the body portion, the leg capable of rotation relative to the body portion, and wherein the leg selectively moves from a first position of use to a second position of use wherein an end of the leg is positioned away from the body portion, wherein the body portion includes a panel that when removed exposes the first sharpening member and the second sharpening member.

A knife sharpening device, comprising: a base portion; a body portion interconnected to the base portion; a first opening in the body portion that accommodates a first sharpening member; a second opening in the body portion that accommodates a second sharpening member; and a leg associated with the base portion and operatively interconnected to the body portion, the leg capable of rotation relative to the body portion, and wherein the leg selectively moves from a first position of use to a second position of use wherein an end of the leg is positioned away from the body portion, wherein the leg has a first end and a second end associated with the base portion, wherein the first position of use locates the first end and the second end adjacent to the body portion, and wherein the second position of use locates the first end away from the body portion and the second end away from the body portion.

A knife sharpening device, comprising: a body having at least one groove that accommodates a sharpening member; a base interconnected to the housing; and a leg rotatably associated with the base, the leg having a first position of use wherein the leg is in line with the body, and a second position of use wherein the leg is positioned at an angle relative to the body.

A knife sharpening device, comprising: a body having at least one groove that accommodates a sharpening member; a base interconnected to the housing; and a leg rotatably associated with the base, the leg having a first position of use wherein the leg is in line with the body, and a second position of use wherein the leg is positioned at an angle relative to the body, wherein the second position of use is defined by the leg being generally orthogonal to the body.

A knife sharpening device, comprising: a body having at least one groove that accommodates a sharpening member; a base interconnected to the housing; and a leg rotatably associated with the base, the leg having a first position of use wherein the leg is in line with the body, and a second position of use wherein the leg is positioned at an angle relative to the body, wherein at least one groove comprises a first groove for a coarse sharpening member and a second groove for a fine sharpening member.

A knife sharpening device, comprising: a body having at least one groove that accommodates a sharpening member; a base interconnected to the housing; and a leg rotatably associated with the base, the leg having a first position of use wherein the leg is in line with the body, and a second position of use wherein the leg is positioned at an angle relative to the body, wherein the leg is interconnected to the body with a pivoting interconnection.

A knife sharpening device, comprising: a body having at least one groove that accommodates a sharpening member; a base interconnected to the housing; and a leg rotatably associated with the base, the leg having a first position of use wherein the leg is in line with the body, and a second position of use wherein the leg is positioned at an angle relative to the body, wherein the body includes at least one finger recess.

A knife sharpening device, comprising: a body having at least one groove that accommodates a sharpening member; a base interconnected to the housing; and a leg rotatably associated with the base, the leg having a first position of use wherein the leg is in line with the body, and a second position of use wherein the leg is positioned at an angle relative to the body, further comprising a plurality of detent protrusions on the base; and a plurality of detent recesses on the leg, wherein the plurality of detent protrusions partially extend into the plurality of detent recesses to secure the leg in at least one of the first position of use and the second position of use.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
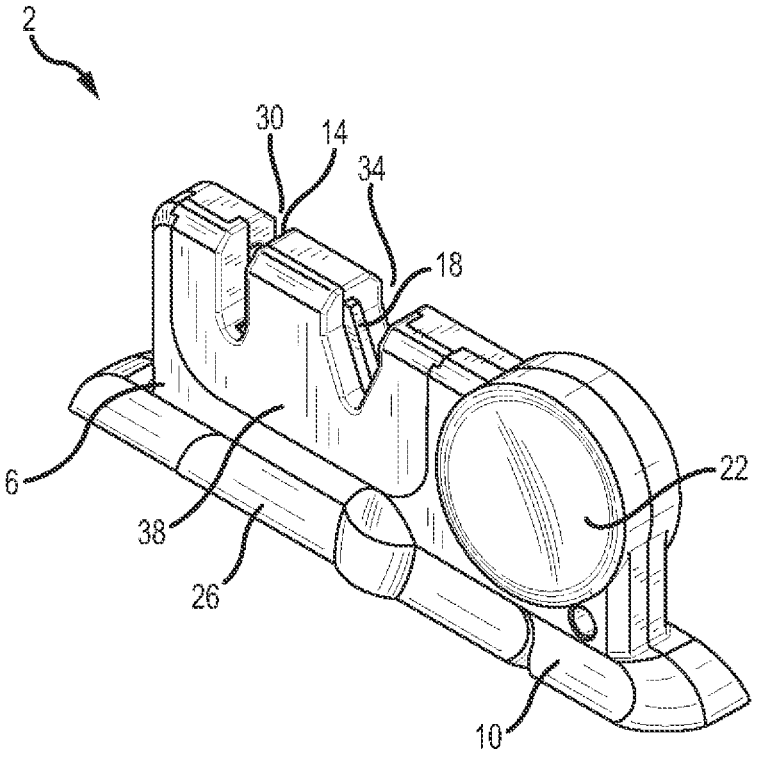
FIG. 1 is a perspective view of the knife sharpening device of one embodiment of the present invention.

To assist in the understanding of one embodiment of the present invention the following list of components and associated numbering found in the drawings is provided herein:

Component
2 Knife sharpening device
6 Body
10 Base
14 Fine sharpening member
18 Coarse sharpening member
22 Finger recess
26 Leg
28 Pivot
30 Recess
34 Recess
38 Panel
40 Detent Recess
42 Detent Protrusion
46 First end
52 Second end
56 Pad
60 Blade It should be understood the drawings are not necessarily to scale. In certain instances, details that are unnecessary for an understanding of the invention or that render other details difficult to perceive may have been omitted. It should be understood, of course, that the invention is not limited to the particular embodiments illustrated herein.

DETAILED DESCRIPTION

FIGS. 1-7 show a knife sharpening device 2 of one embodiment of the present invention that includes a body 6 interconnected to a base 10. The body 6 includes at least one sharpening member. Here, a fine sharpening member 14 and a coarse sharpening member 18 are provided. However, those of ordinary skill in the art will appreciate that additional sharpening members may be employed, wherein a wider body 6 could accommodate additional sharpening members. The body 6 also includes a finger recess 22 that helps increase the ability to grip and improves the knife sharpening device stability during use. The base 10 also includes a rotatable leg 26. In a first stored position of use, as shown in FIG. 1, the leg 26 is in line with the base 10. FIGS. 4-7 show the knife sharpening device 2 in a second position of use where the leg 26 is generally perpendicular to the body 6, which enhances stability when the knife sharpening device 2 is being used.

Figure 2:
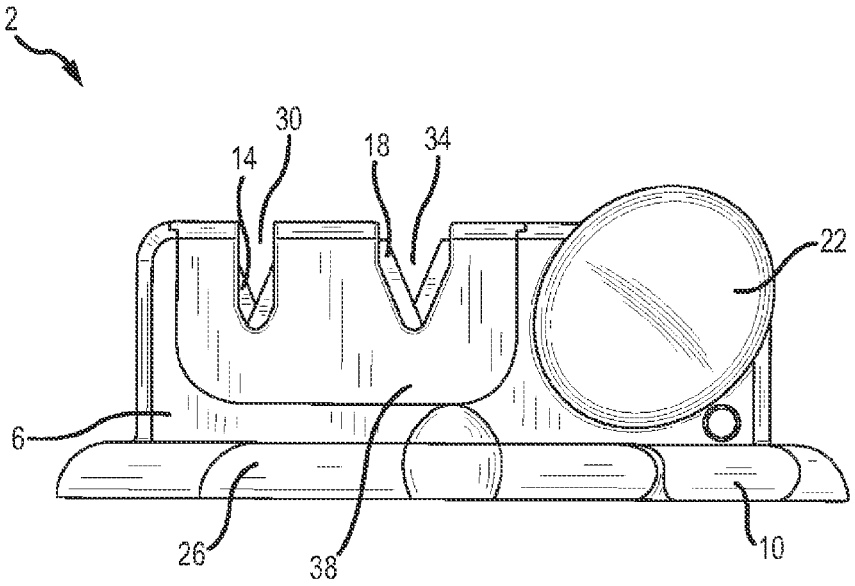
FIG. 2 is a front elevation view of the knife sharpening device shown in FIG. 1.
Figure 3:
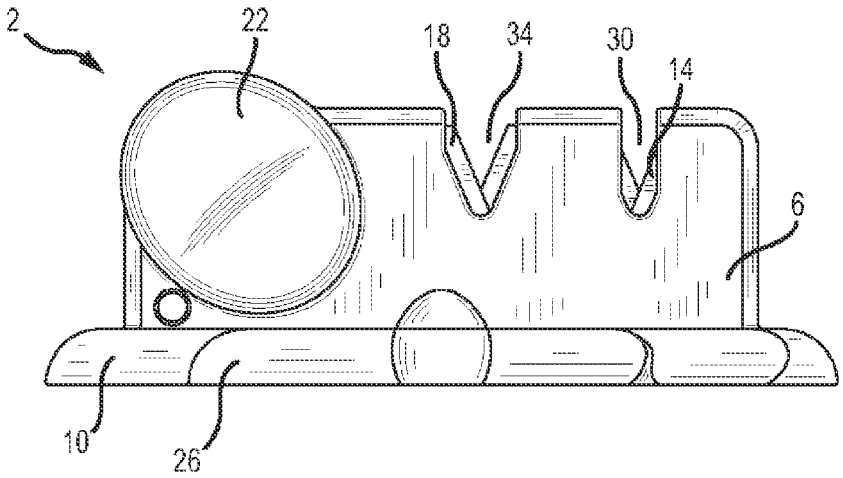
FIG. 3 is a rear elevation view of the knife sharpening device shown in FIG. 1.

FIGS. 1-3 show the knife sharpening device in a first position of use for storage. In this low-profile configuration, the knife sharpening device can easily fit within a user's pocket. The sharpening members in this embodiment comprise the fine sharpening member 14 positioned in a recess 30 within the body. The coarse sharpening member 18 is positioned within a second recess 34 providing the body. The body 6 includes a selectively removable panel 38 that when removed exposes the individual components of the fine sharpening member 14 and the coarse sharpening member 18. Thus, when the fine sharpening member 14 or coarse sharpening member 18 become worn or less effective, they can be adjusted, i.e., rotated in the case of rods or flipped in the case of carbide plates, to provide an ideal sharpening member. Alternatively, the sharpening members can be replaced and the panel 38 reconnected.

FIG. 2 shows how the fine sharpening member 14 and the coarse sharpening member 18 are positioned are comprised of separate components that are positioned at an optimum angle to create optimum sharpening characteristics in the knife blade. That is, the angle is designed such that users can simply place the blade within the groove and pull it perpendicular to the body 6 without having to concentrate on angling the blade properly against the sharpening components. The fine sharpening member is comprised of two ceramic rods angled about 44° relative to each other. The coarse sharpening member is comprised of 2 carbide plates with edges angled about 44° relative to each other.

FIGS. 4-7 show the knife sharpening device 2 in the second position of use wherein the leg 26 is rotated outwardly about a pivot 28 to be positioned generally perpendicular to the body 6. In this configuration, the lateral footprint is increased over the footprint of the knife sharpening device 2 in its first position of use. Accordingly, the body 6 does not tilt or sway when the blade is pulled across the sharpening members. Any movement of the blade sharpening device, which can occur when using the devices disclosed in the references listed above, is unsafe and can adversely affect sharpening and the proper sharpening angle. Although a leg 26 with a first end 46 of the second end 52 is shown, those of ordinary skill in the art will appreciate that the leg 26 need only to extend in the direction of knife pull to increase the device's stability.

Figure 6:
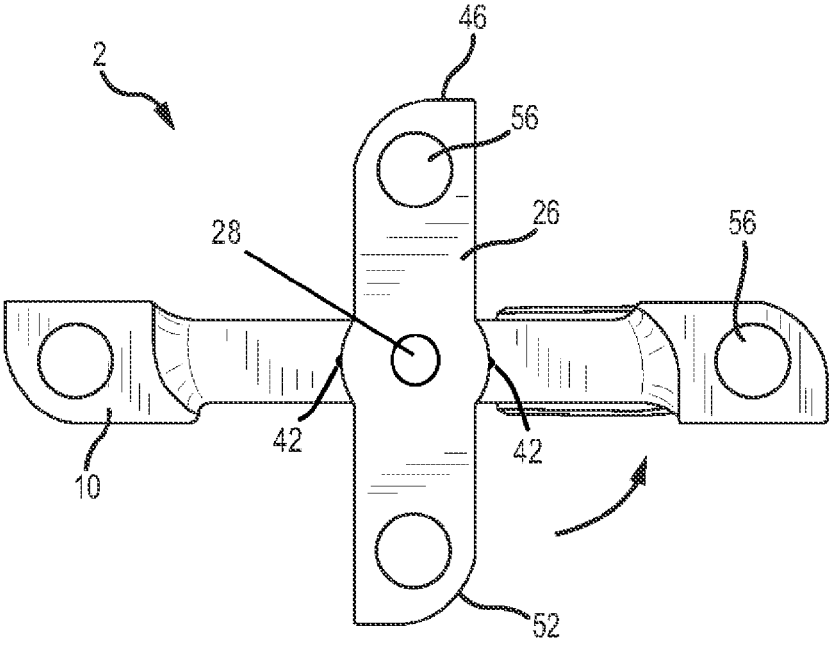
FIG. 6 is a bottom plan view of the knife sharpening device in the configuration of FIG. 4.

The leg may terminate in ends with shaped or arcuate profiles that fit into a corresponding shaped profile in the base 10. This ensures that the leg 26 can only rotate in one direction, as rotation in the opposite direction is prevented by engagement of the end surface with the corresponding surface in the base (See FIG. 6.) FIG. 6 also shows that the base leg may include a plurality of compliant pads 56 that help the device firmly grasp the surface on which it is placed.

Figure 7:
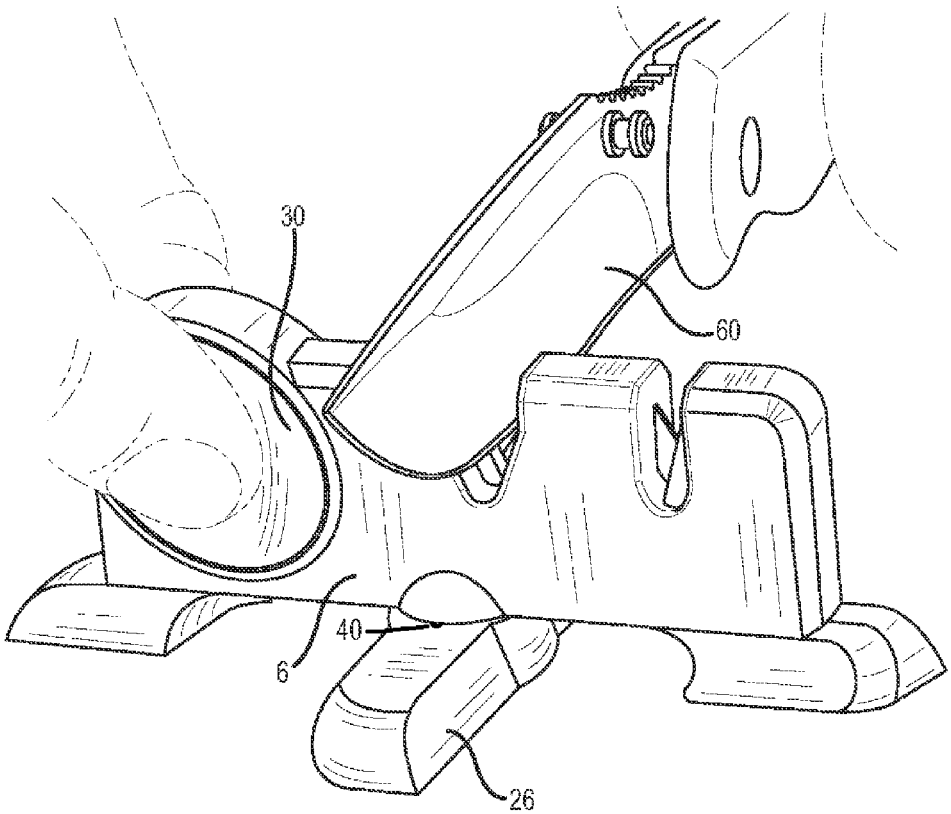
FIG. 7 shows one embodiment of the present invention in use.

FIG. 7 shows one embodiment of the present invention in use. Here, the user grasps the finger recess 22 with their thumb and forefinger after the leg 26 is rotated to the second position of use. The sharpening device configured in this way remains stable as the blade 60 is pulled through each sharpening member and, thus, a high degree of control is achieved.

Figure 4:
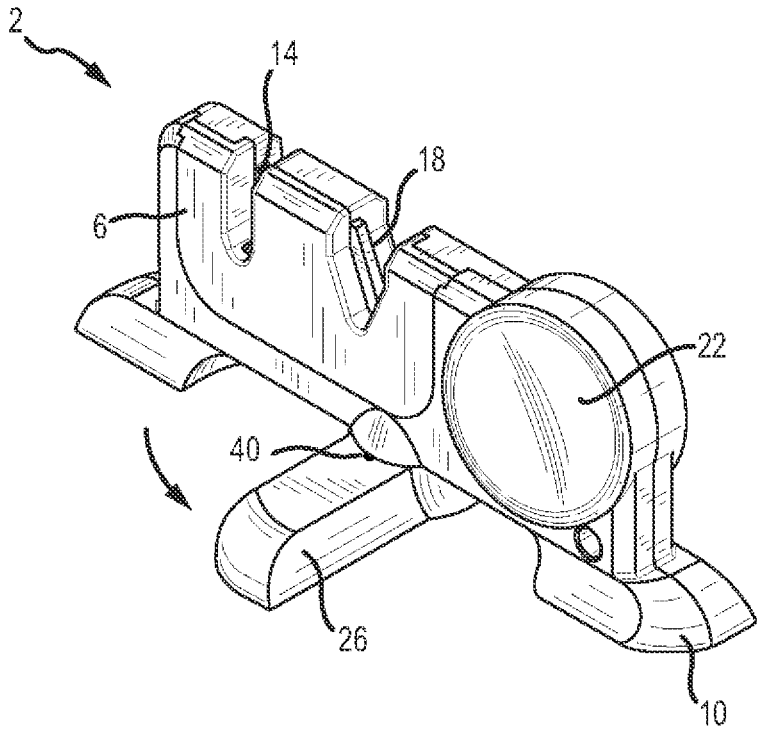
FIG. 4 is a perspective view of the knife sharpening device shown in a second position of use wherein a rotatable leg portion of the base is deployed.
Figure 5:
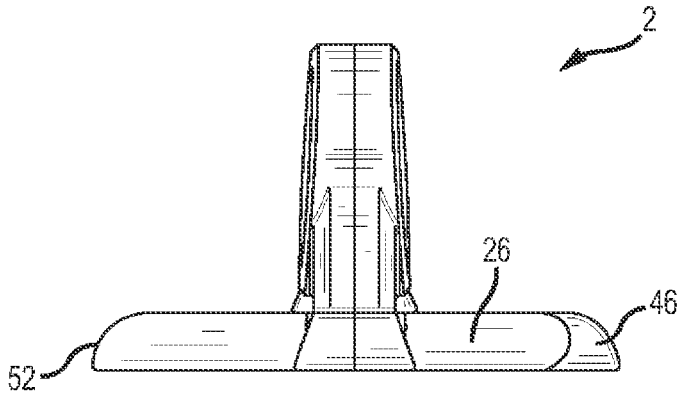
FIG. 5 is a right elevation view of the knife sharpening device in the configuration shown in FIG. 4.

FIGS. 4-7 also show a detent system that may be used to secure the positions of the knife sharpening device 2, specifically the position of the leg 26 with respect to the base 10. The detent system is used to mechanically resist or arrest rotation of the leg 26 relative to the base 10. FIGS. 4 and 7 show a detent recess 40 on a top surface of the leg 26, and FIG. 6 shows a detent protrusion 42 on a bottom surface of the base 10. The detent protrusions 42 partially extend into the detent recesses 40 to achieve the desired resisting or arresting effect. Therefore, the knife sharpening device 2 may be secured in the first position of use as shown in FIGS. 1-3 and/or the second position of use as shown in FIGS. 4-7.

The detent system may have a variety of configurations. The detent protrusions 42 and the detent recesses 40 are circular in FIGS. 4 and 6-7. However, in some embodiments, the detent protrusions 42 may have a bar shape, and the detent recesses 40 may have a slot shape. Further, the detent protrusions 42 and recesses 40 are partially visible on the leg 26 and the base 10. It will be appreciated that in various embodiments, the detent protrusions 42 and recesses 40 are positioned closer to the axis of rotation and the pivot 28. Accordingly, in these embodiments, the detent protrusions 42 and recesses 40 would not be visible in FIGS. 4 and 6-7. Further still, there may be several variations in the number of detent protrusions 42 and recesses 40. In the embodiment in FIGS. 4-7, there are four detent protrusions 42 and four detent recesses 40 arrayed around axis of rotation and the pivot 28. This allows the leg 26 to be secured in the first and second positions. However, some embodiments of the invention may have any number of detent protrusions 42 and recesses 40 to secure the leg 26 relative to the base 10 in any number of positions of use. It will also be appreciated that some embodiments may not include a detent system.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A knife sharpening device, comprising:

a base portion having an upper surface, a lower surface spaced from said upper surface, said lower surface being generally planar, thereby defining a normal axis;

a body portion interconnected to said base portion, said body portion having a first face and a second face spaced from said first face, and an upper surface;

a first opening in said upper surface that accommodates a first sharpening member; a second opening in said upper surface that accommodates a second sharpening member; and a monolithic leg having a first end and a second end, said monolithic leg associated with said base portion and operatively interconnected to said body portion, said monolithic leg capable of rotation about a single pivot that has as a centralized axis parallel to said normal axis of said base portion, and wherein said monolithic leg selectively moves from a first position of use, wherein said first end and said second end are positioned adjacent to said body portion, and a second position of use, wherein said first end is positioned away from said first face of said body portion and said second end is positioned away from said second face of said body portion so as to increase a lateral footprint of said knife sharpening device.

2. The device of claim 1, wherein at least one of said first sharpening member and said second sharpening member are removable.

3. The device of claim 1, wherein at least one of said base portion and said monolithic leg have compliant pads adapted for selective engagement with a support surface.

4. The device of claim 1, further comprising a finger recess incorporated in to at least one of said first face and said second face.

5. The device of claim 1, further comprising a first finger recess incorporated into said first surface and a second finger recess incorporated into said second surface, said first finger recess and said second finger recess being in direct opposition to each other.

6. The device of claim 1, wherein said first end and said second end are comprised of arcuate outer surfaces that selectively engage corresponding arcuate surfaces integrated into said base portion.

7. The device of claim 1, wherein said first sharpening member is comprised of a first portion and a second portion positioned at an angle relative to each other, and wherein said second sharpening member is comprised of a first portion and a second portion positioned at an angle relative to each other.

8. The device of claim 1, wherein said body portion has a panel that when removed exposes said first sharpening member and said second sharpening member.

9. A knife sharpening device, comprising:

a base portion;

a body portion interconnected to said base portion;

a first opening in said body portion that accommodates a first sharpening member;

a second opening in said body portion that accommodates a second sharpening member; and a monolithic leg associated with said base portion and operatively interconnected to said body portion, said monolithic leg capable of rotation about a single pivot that has a centralized axis parallel to a normal axis of said base portion, and wherein said monolithic leg selectively moves from a first position of use to a second position of use, wherein a first end and a second end of said monolithic leg is positioned away from and on opposite sides of said body portion.

10. The device of claim 9, wherein at least one of said first sharpening member and said second sharpening member are removable.

11. The device of claim 9, wherein at least one of said base portion and said monolithic leg have compliant pads adapted for selective engagement with a surface.

12. The device of claim 9, further comprising a finger recess incorporated into said body portion.

13. The device of claim 9, wherein said first end and said second end of said monolithic leg are comprised of an arcuate surface that selectively engages corresponding arcuate surfaces integrated into said base portion.

14. The device of claim 9, wherein said first sharpening member is comprised of a first portion and a second portion positioned at an angle relative to each other, and wherein said second sharpening member is comprised of a first portion and a second portion positioned at an angle relative to each other.

15. The device of claim 9, wherein said body portion includes a panel that when removed exposes said first sharpening member and said second sharpening member.

16. The device of claim 9, wherein said monolithic leg has a first end and a second end associated with said base portion, wherein said first position of use locates said first end and said second end adjacent to said body portion, and wherein said second position of use locates said first end away from said body portion and said second end away from said body portion.

17. A knife sharpening device, comprising:

a body having at least one groove that accommodates a sharpening member;

a base interconnected to said housing; and a monolithic leg rotatably associated by a single pivot point with said base and operatively interconnected to said body, said monolithic leg capable of rotation about a single pivot that has a centralized axis parallel to a normal axis of said base, said unitary monolithic leg having a first position of use wherein said monolithic leg is in line with said body, and a second position of use wherein said monolithic leg is positioned at an angle relative to said body, wherein a first end and a second end of said monolithic leg are positioned away from and on opposite sides of said body.

18. The knife sharpening device of claim 17, wherein said second position of use is defined by said monolithic leg being generally orthogonal to said body.

19. The knife sharpening device of claim 17, wherein at least one groove comprises a first groove for a coarse sharpening member and a second groove for a fine sharpening member.

20. The knife sharpening device of claim 17, wherein said body includes at least one finger recess.

21. The knife sharpening device of claim 17, further comprising:

a plurality of detent protrusions on said base; and a plurality of detent recesses on said monolithic leg, wherein said plurality of detent protrusions partially extend into said plurality of detent recesses to secure said monolithic leg in at least one of said first position of use and said second position of use.

* * * * *